United States Patent [19]

Englert et al.

[11] Patent Number: 4,458,508

[45] Date of Patent: Jul. 10, 1984

[54] ARRANGEMENT FOR CONTROL OF THE DISPLACEMENT MOVEMENT OF A GUIDE BAR IN A WARP KNITTING MACHINE OR THE LIKE

[75] Inventors: Norbert Englert, Schafheim; Gerhard Bergmann, Heusenstamm, both of Fed. Rep. of Germany

[73] Assignee: Karl Mayer Textilmaschinenfabrik GmbH, Obertshausen, Fed. Rep. of Germany

[21] Appl. No.: 474,268

[22] Filed: Mar. 11, 1983

Related U.S. Application Data

[63] Continuation-in-part of Ser. No. 373,730, Apr. 30, 1982, Pat. No. 4,414,826.

[30] Foreign Application Priority Data

Apr. 14, 1982 [DE] Fed. Rep. of Germany ..... 3213663

[51] Int. Cl.[3] ..... D04B 23/00

[52] U.S. Cl. ..... 66/207

[58] Field of Search ..... 66/207, 203, 204, 205

[56] References Cited

U.S. PATENT DOCUMENTS

| | | | |
|---|---|---|---|
| 3,089,322 | 3/1963 | Bruce et al. | 66/207 |
| 3,478,543 | 11/1969 | Faninger | 66/205 |
| 3,653,232 | 4/1972 | Walter | 66/205 |
| 3,729,954 | 5/1973 | Ducol | 66/205 |
| 4,312,196 | 1/1982 | Englert | 66/207 |
| 4,335,590 | 6/1982 | Bergmann et al. | 66/207 |

FOREIGN PATENT DOCUMENTS

| | | | |
|---|---|---|---|
| 270494 | 2/1914 | Fed. Rep. of Germany | 66/207 |
| 458199 | 3/1925 | Fed. Rep. of Germany | 66/207 |

*Primary Examiner*—Ronald Feldbaum
*Attorney, Agent, or Firm*—Omri M. Behr

[57] ABSTRACT

A summing arrangement controls the underlap and overlap movement of a guide bar of a warp knitting machine. The arrangement has a plurality of ordered elements each having at least one curved face. The ordered elements are mounted on the machine to allow a variation in the spacing between each. Also included is a plurality of adjustable roller devices, one between each adjacent pair of elements. Each of these roller devices can roll upon and push at least one of the elements at its curved face. An overlap arrangement can move against at least one of the ordered elements to influence each overlap movement.

12 Claims, 5 Drawing Figures

201
202
203
204
205
206
207
208
209
210
211
212
213
214
215
216
217
218
219
220
221
222
225
226
227
228
233
236
237
238
239
240
241
242
243
244
245
246
247
248
249
250
251
252
253
1Ü
1T
2T
4T
8T
16T
47T
III
U 254
255
3T
1Ü

216
217
222
233
234
235

ARRANGEMENT FOR CONTROL OF THE DISPLACEMENT MOVEMENT OF A GUIDE BAR IN A WARP KNITTING MACHINE OR THE LIKE

This Application is a continuation-in-part of copending Application Ser. No. 373,730 filed Apr. 30, 1982 now U.S. Pat. No. 4,414,826.

BACKGROUND OF THE INVENTION

1. Field of the Invention

The present invention relates to a guidebar shogging apparatus for warp knitting machines and the like and, in particular, to an apparatus that is adjustable and automatically programmable in fixed increments that are proportional to the knitting machine needle spacing.

2. Discussion of the Relevant Art

As is shown in the disclosure of our co-pending parent Application Ser. No. 373,730 filed Apr. 30, 1982, the ordered control elements can be displaced in a substantially frictionless manner while the guide bars and paths of the summation drive are in force-transferring contact. This permits substantially higher working speeds that have been customary with those summation drives wherein the guide bars have to be taken out of contact with the summation drive when the control arrangement is activated. There is a need to provide an arrangement of the previously described type which is improved in such a way as to increase the availability of different types of patterns to be produced by the machine.

SUMMARY OF THE INVENTION

A summing arrangement for controlling the underlap and overlap motions of a guide bar of a warp knitting machine has a plurality of ordered elements. Each of these elements has at least one bearing face and each is mounted in the machine to allow a variation in the spacing between each. Also included is a plurality of spreading means. A different corresponding one of the spreading means is engaged between each adjacent pair of the elements for pushing at least one of the elements at its bearing face. The summing arrangement also employs a control means having an underlap and an overlap arrangement. This control means is coupled to the plurality of spreading means for operating them according to a predetermined pattern to influence the underlap motions. The overlap arrangement is operable to move against at least a predetermined one of the ordered elements to influence each of the overlap motions.

According to a related method of the same invention the overlap and underlap motions of a guide bar are controlled and driven by a plurality of ordered elements having an adjustable composite length. The method includes the step of adjusting the spacing between predetermined ones of the elements to produce the underlap motion. The method also includes the step of moving at least a predetermined one of the elements to influence each of the overlap motions.

By using apparatus and methods of the foregoing type an improved control arrangement is provided which may be so activated during the appropriate portion of the working cycle that it performs an underlap displacement and causes a displacement during the appropriate time of the working cycle to perform one overlap displacement.

Preferably, during a working cycle, control arrangements influence a summation arrangement and may be timely displaced so that there is provide an underlap displacement and an overlap displacement. Both are desirable for patterning. The summation drive permits the size and direction of the underlap displacement to be varied. Preferably the control arrangement for the overlap displacement is constructed in the same manner as that for the underlap displacement control arrangement. Suitably, the overlap displacement control arrangements have a similar impulse roller which can work substantially without frictional burdens. In the preferred embodiment of the invention, at least one of the underlap displacement control arrangements may simultaneously serve as an overlap displacement control direction in that it is activatable during the course of the work cycle so that it can perform either an underlap displacement and/or an overlap displacement. This reduces the complexity for the overlap displacement. A twofold use of the work cycle may be put into effect without further technical control problems.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENTS

Figure 1:
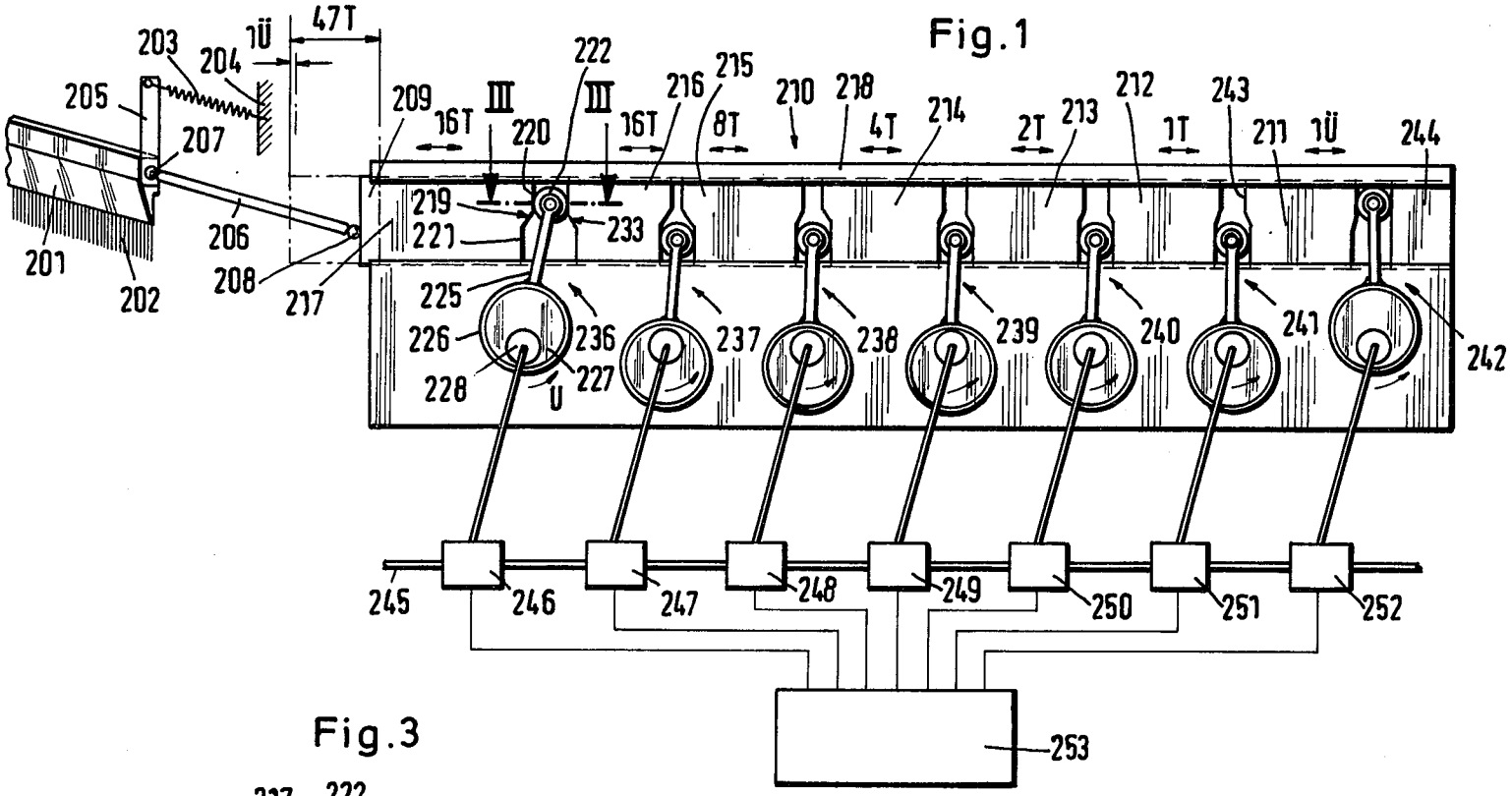
FIG. 1 is a schematic side elevational view of a first embodiment of an arrangement in accordance with the present invention.
Figure 3:
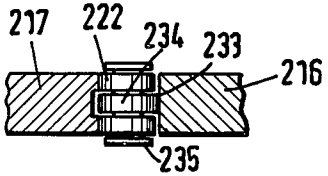
FIG. 3 is a partial cross-sectional view along lines III—III of FIG. 1.

Referring to FIG. 1, its upper portion is substantially equivalent to the apparatus shown in FIG. 3 of copending Application Ser. No. 373,730 filed Apr. 30, 1982. Hence the same components will be designated with the same reference numbers. Guide bar 201 carries a plurality of spaced, parallel, conventional guides 202 and is biased by tension spring 203. Thread guide bar 201 is mounted to slide longitudinally and perform a shogging motion. One end of spring 203 is held by a fixed support 204 and its other end connects to and acts upon guide bar 201 via connecting means 205, an upright bar attached to one end of guide bar 201. Rod 206 is held in contact with the guide bar 201 via roller bearing 207. The other end of rod 206 is held via roller bearing 208 against the free end 209 of summing arrangement 210. This summing drive 210 comprises seven ordered elements, 211 through 217 in the shape of blocks which are longitudinally slidable in fixed guideway 218. Element 217 has inside curved displacement surface 219, whose two end plateaus 220 and 221 represent the extremes of displacement caused by surface 219 to element 217.

A plurality of spreading means is shown employing roller means 222 and 234, illustrated in FIG. 1 and in more detail in FIG. 3. Rollers 222 are a pair of spaced coaxial rollers mounted on common axis 235. Mounted between roller pair 222 on the same axle 235 is roller 234, structured the same as rollers 222. Rollers 222 roll on surface 219 of element 217. Since surface 219 has a shallow groove aligned with roller 234 (FIG. 3) roller 234 does not engage surface 217 and instead rotates independently of rollers 222. The axle of axis 235 is supported by the forked upper end of connecting rod 225 whose lower end terminates in circumferential ring 226. Rod 225 can be reciprocated by eccentric rotation of eccentric cam 227 within circumferential ring 226. Cam 227 is rigidly affixed to shaft 228. Impulse roller 234 rolls on the central ridge (FIG. 3) of running surface 233. This running surface 233 also serves as a displacement curve and is oriented conversely (mirror-image) to that of displacement surface 219. Because it is ridged, surface 233 does not engage rollers 222. When cam 227 is rotated 180° from the bottom position to the illustrated upper position, the impulse rollers 222 and 234 move upwardly, across surfaces 219 and 233, respectively, whereby element 217 is moved to the left by 16T units relative to element 216 (wherein T corresponds to one needle space of the needle bar). The foregoing described a portion of an underlap displacement control arrangement 236. The other underlap control arrangements 237, 238, 239, 240 and 241, operate in a similar manner. Each have a similar structure employing an eccentric cam driving the lower circumferential ring of a connecting rod whose forked upper end supports three coaxial rollers. The rollers of arrangement 237 are between elements 216 and 215. The rollers of arrangements 237, 238, 239, 240 and 241 are positioned in front of ordered elements 215, 214, 213, 212 and 211, respectively. Each of the elements 211–217 is slidably mounted in guideway 218. However, arrangement 237 provides a displacement of 16T units, arrangement 238 a displacement of 8T units, arrangement 239 a displacement of 4T units, arrangement 240 a displacement of 2T units, and arrangement 241 a displacement of 1T unit. Thus, it is possible to provide for a guide bar displacement of between 1T and 47T units. There is further provided an overlap displacement arrangement 242. This is structurally equivalent to the underlap displacement control arrangement described herein above. Specifically arrangement 242 comprises a pushing means including an eccentric cam 242*b* rotatable within the lower ring of rod 242*a* whose forked upper end supports three coaxial rollers. However, in this case, the impulse rollers of rod 242*a* rest in part, against a supplemental element 244 fixed within guideway 218 so that by activation of the overlap displacement control arrangement 242, resistance surface 243 on displaceable element 211 (namely the resistance surface of the outermost underlap displacement setting arrangement 241) is displaced. This setting arrangement 242 may thus cause a displacement of 1U which corresponds to one needle space in the overlap setting.

A control means is shown connected to the shafts of arrangements 236–242 to rotate them, reciprocate their rods and change the spacing between elements 211–217 and 244. All shafts, such as shaft 228, are activatable by a shaft 245 running at main shaft rotation speed. Shaft 245 is coupled to couplers 246 through 252 which have an output for driving the cams of arrangements 236 through 242, respectively. Couplers 246–251 are part of a underlap arrangement, coupler 252 being part of an overlap arrangement. All couplers are controlled by electrical control signals emanating from the program arrangement 253. Upon provision of such a control signal, one or more of the appropriate shafts, such as shafts 228, turns through an angle of 180° in the direction of arrow Z. This rotation causes a displacement of the impulse roller from the lower position to the upper position or the reverse. Program arrangement 253 may take the form of a computer such as a mirocomputer having sufficient memory to produce a pattern of output signals to couplers 246–252. The pattern is preferably updated before the end of each cycle of shaft 245. Computer 253 may have a transducer coupled to the main shaft 245 to trigger the computer and cause the above mentioned updating.

The choice of the control arrangement to be activated can be provided either by means of a jacquard apparatus, an electronic program controller, or the like. The desired correct activation time point may be readily provided by the main shaft 245 of the machine. It is particularly advantageous if both the underlap displacement control arrangement 246–251 as well as the overlap displacement control arrangement 252 is activated by a program steerable coupling. Such a program steerable coupling can be activated either by a simple instruction and thus lead to a displacement of the appropriate control arrangement. By means of programs both the appropriate underlap displacements as well as the overlap displacements may be utilized to provide a variety of desired patterns.

In the embodiment of FIG. 1, the overlap control arrangement 242 need not be located at the end of the summing drive but may also be located at another position. However, it is advantageous to provide the overlap displacement control arrangement 242 at the support surface of the first (or outermost) underlap displacement control arrangement, which may be located at the end of the summation drive furthest away from the guide bar. In this way the rest of the summation drive may remain undisturbed. Also, it is desirable to provide the support surface on an element (e.g. surface 243 of element 211) displaceable in the direction of the drive by an impulse roller of the overlap displacement control arrangement. The overlap displacement control arrangement thus has practically the same construction as the underlap displacement control arrangement. This leads to a readier and simpler form of construction.

Figure 2:
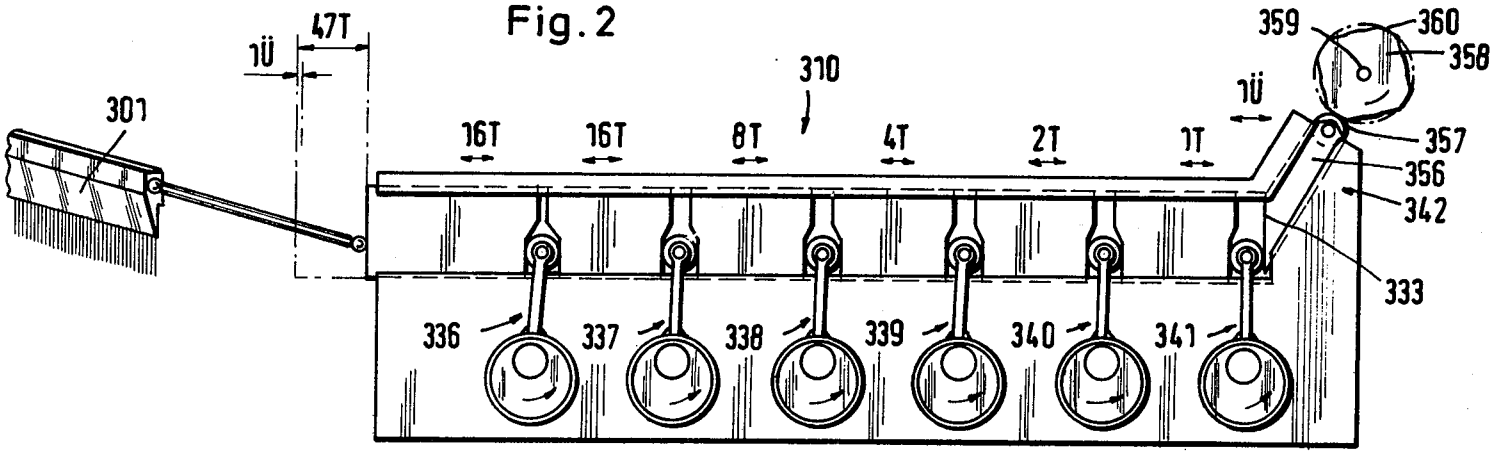
FIG. 2 is a schematic side elevational view of a second embodiment in accordance with the present invention.

In the modification of FIG. 2, many of the same parts are utilized as those in FIG. 1. Similar parts are therefore shown increased by one unit in the one hundreds digit. The system may, however, be differentiated in that the running surface 333 for the impulse roller of first underlap control arrangement 341, is formed by the angled head surface of a displaceable slider 356 set at an angle to the drive displacement direction of the underlap setting arrangement 342. Slider 356 carries at its upper outside end impulse roller 357 which is contacted by control cam 358. Cam 358 is supported by shaft 359 which rotates at ¼ of the rate of rotation of the main shaft (shaft 245 of FIG. 1). Cam 358 has four protrusions 360. Thus during each work cycle there is provided a reciprocating overlap movement of one needle space, i.e. 1U. Slider 356 will be urged against cam 358 by the same spring forces described in connection with FIG. 1.

There exists another possibility in that the overlap displacement control arrangement is activated either by the above illustrated control cam or control chain. In either case, the patterning caused by the overlap displacement is limited to the instructions carried by the appropriately chosen control cam or chain. However, in most cases this has been found adequate. It is advantageous to provide support surface 333 as the angled face surface of slider 356, which is angularly displaceable with respect to the drive displacement direction of the overlap displacement control arrangement. Such a control arrangement may be added to an already constructed summation drive.

In an arrangement such as the foregoing, the overlap displacement can be in the same direction, reversal occurring preferably during underlap. It is further advantageous if, for the maintainence of the direction of the overlap displacement direction in sequential working cycles, the overlap displacement setting arrangement 342 is simultaneously activatable with the underlap displacement control arrangement 336–341. This permits the overlap displacement control arrangement 342 to return to the starting position it held in the previous work cycle. In this latter control movement, the actual underlap displacement is different than the one obtained by utilizing the regular underlap displacement control arrangement alone.

Figure 5:
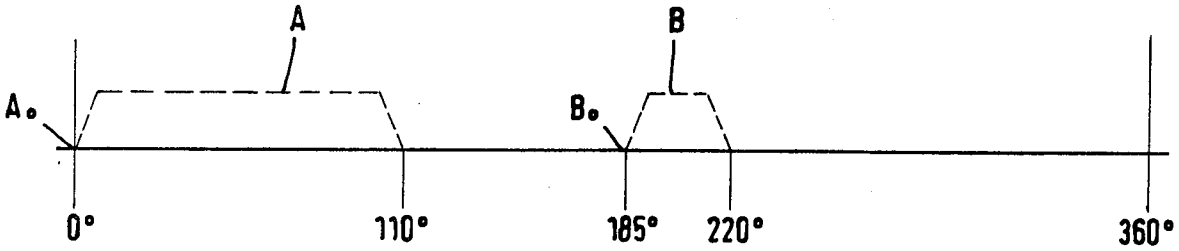
FIG. 5 is a timing diagram showing the underlap and overlap times.

In operation, guide bar 201 may be displaced as shown by the ordinate of the timing diagram of FIG. 5. This diagram may be considered the motion intervals corresponding to the magnitude of shogging velocity. In the following description the apparatus of FIG. 1 will be considered, although the operation of the apparatus of FIG. 2 will be similar except its overlap motion will be defined by its cam 358. In FIG. 5, it will be seen that each work cycle, comprises a 360° rotation (abscissa) of main shaft 245 (FIG. 1). During period A which, for example, runs from 0° to 110°, there is provided an underlap and during a period B which similarly runs from 185° to 220° there is provided an overlap.

Figure 4:
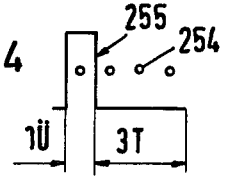
FIG. 4 is a partial lapping diagram showing the underlap and overlap occurring in one work cycle.

In FIG. 4, there are illustrated a plurality of needles 254 and a line 255 schematically illustrating the travel path of guide 201 (FIG. 1). In this example it is assumed that prior to time Ao all arrangements 236–242 are retracted to provide the minimum spacing between elements 217 and 244. The activation of the underlap displacement control arrangements 236–241 by the appropriate couplings 246–251 are initiated at the beginning of the underlap period A, that is to say at point Ao or shortly before. In this example, at time point Ao, the underlap displacement control arrangement 240 and 241 are activated so that an underlap displacement of 3T occurs. At time Ao computer 253 energizes couplers 250 and 251. Accordingly, shaft 245 causes rotation of the cams and lifting of the rollers of arrangements 240 and 241 during interval A. Arrangements 240 and 241 provide displacements to guide 201 of 2T and 1T, respectively, for the total displacement of 3T shown in FIG. 4. This causes an underlap motion in front of the needles (not shown). After interval A, guide bar 201 may swing backwardly, completing the swing before time Bo.

At time point Bo the overlap displacement control arrangement 242 is activated to provide an overlap of 1U in the same direction as underlap motion 3T, in this cycle. To this end computer 253 energizes coupler 252 to crank cam **242*b* 180°, thereby raising rod 242*a* to the position shown in FIG. 1. This cranking shogs guide bar 201 and provides an overlap motion occurring over approximately 35° of rotation of main shaft 245. As noted, the activation of the overlap displacement control arrangement 242 by the appropriate coupling 252** commences at the beginning of the underlap period B, that is to say at time point Bo or shortly before. Thus, the activation time points Ao and Bo occur approximately 185° relative to each other. After interval B the knitting machine may perform a stitch before the start of the next cycle.

The coupler 252 of the appropriate main shaft 245 may turn around 180° with greater speed than the other couplers since for overlap a smaller rotational angle of the work cycle is available than for the underlap. In this example, this is between 185° and 220° as opposed to 0° through 110°. Since the overlap movement usually comprises at the most two needle spaces, it is no great problem to achieve this displacement during the work angle B of FIG. 5. On the other hand, in an underlap when one has the displacement of 4, 8 or 16T, a longer time is necessary.

The angular displacements in FIG. 5 preferably have substantially the shown size and position. They may, however, be somewhat varied. For example, the length of segment A may lie between 100° and 120° and segment B may lie between 30 and 40°.

The displacements in the next work cycle would depend upon the desired pattern. If it is desired in the next work cycle that the overlap displacement will proceed in an opposite direction, the overlap displacement setting arrangement 242 can be reversed in the next time interval B. On the other hand, if it is desired that in the next work cycle the overlap displacement direction proceed in the same direction, then the overlap displacement control arrangement 242 is activated at time point Ao so that at time point Bo it may again provide the same overlap displacement as it did in the previous cycle. This movement of the overlap displacement control arrangement 242 at time point Ao can be compensated in that the underlap displacement provided by control arrangement 236–241 are increased by 1T unit with respect to the actually desired underlap displacement. For example, it an extension of 3T units is required (that is a total of 7T units, taking into account the prior underlap of 3T and overlap of 1U) arrangements 239 and 242 will be actuated by computer 253. As a result, arrangement 239 will provide a displacement of 4T, but the opposite displacement of arrangement 242 of 1U produces a net displacement of 3T. Therefore arrangement 242 has been retracted and is a condition to raise rod **242*a*** during the succeeding overlap interval B so that two succeeding overlap intervals work with shogging motions in the same direction.

The embodiment of FIG. 1 can also be activated in such a way that no sharp division is made between the control arrangement 236–241 provided for the underlap displacement and the control arrangement 242 providing for overlap displacement. In fact, the control arrangement 242 can be so activated in dependence upon a program to provide for underlap displacement at time point Ao, provided this activation of arrangement 242 is consistent with the overlap motion required in the next interval B.

During the above-described process example, there is an overlap displacement during each working cycle. If desired, however, one can interrupt the automatic overlap displacement so that the pattern threads may float. By means of the present invention, it is thus possible not only to achieve an underlap displacement, but also an overlap displacement as often as desired, or not at all, and in the desired direction, at higher machine speeds than has heretofore been possible.

It will be understood that various changes in the details, materials, arrangement of parts and operating conditions which have been herein described and illustrated in order to explain the nature of the invention may be made by those skilled in the art within the principles and scope of instant invention.

What is claimed is:

1. A summing arrangement for controlling the underlap and overlap motions of a guide bar of a warp knitting machine comprising:

a plurality of ordered elements each having at least one bearing face and each being mounted in said machine to allow a variation in the spacing between each;

a plurality of spreading means, a different corresponding one being engaged between each adjacent pair of said elements for pushing at least one of said elements at its bearing face; and a control means having an underlap and an overlap arrangement, said control means being coupled to said plurality of spreading means for operating them according to a predetermined pattern to influence the underlap motions, said overlap arrangement being operable to move against at least one of said ordered elements to influence each of the overlap motions.

2. A summing arrangement according to claim 1 wherein said overlap arrangement comprises:

a supplemental element mounted adjacent to at least a given one of said ordered elements; and a pushing means engaged between said supplemental element and said given one of said ordered elements for separating them.

3. A summing arrangement according to claim 2 wherein said ordered elements are ordered from closest to furthest from said guide bar, said overlap arrangement being operable to drive the furthest one of said ordered elements, said farthest one being said given one.

4. A summing arrangement according to claim 3 wherein said overlap arrangement comprises:

a roller means for rolling upon and pushing said furthest one of said ordered elements toward the next to furthest one of said ordered elements.

5. A summing arrangement according to claim 1 wherein said ordered elements are mounted to reciprocate in a drive displacement direction, said overlap arrangement being mounted to reciprocate at a predetermined angle with respect to said drive displacement direction.

6. A summing arrangement according to claim 5 wherein said plurality of spreading means are operable during both the underlap and overlap motions to influence both.

7. A summing arrangement according to claim 1 wherein said control means comprises:

a plurality of program controlled couplers for driving said underlap and overlap arrangements according to a preset pattern.

8. A summing arrangement according to claim 5 wherein said overlap arrangement includes a circulating member mounted in said machine to provide the reciprocation along said predetermined angle.

9. A summing arrangement according to claim 1 wherein said control means is operable over two successive cycles to move said overlap arrangement during said underlap motions in a given direction and in an opposite direction during said overlap motions.

10. A summing arrangement according to claim 1 wherein said plurality of spreading means differ and are ranked by the magnitude of motion of said guide bar each can produce, said overlap arrangement being operable to produce substantially the same magnitude of motion of said guide bar as one of said plurality of spreading means.

11. A method for controlling the overlap and underlap motions of a guide bar driven by a plurality of ordered elements having an adjustable composite length, comprising the steps of:

adjusting the spacing between predetermined ones of said elements to produce said underlap motion; and moving at least a predetermined one of said elements to influence each of said overlap motions.

12. A method according to claim 11 further comprising the step of:

reversing the motion of said predetermined one of said elements during said underlap motion.

* * * * *